US008350651B2

(12) United States Patent
Shimizu

(10) Patent No.: US 8,350,651 B2
(45) Date of Patent: Jan. 8, 2013

(54) OIL IMMERSED SOLENOID

(75) Inventor: Hiroaki Shimizu, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 13/063,184

(22) PCT Filed: Aug. 21, 2009

(86) PCT No.: PCT/JP2009/004024

§ 371 (c)(1),
(2), (4) Date: Mar. 9, 2011

(87) PCT Pub. No.: WO2010/029688

PCT Pub. Date: Mar. 18, 2010

(65) Prior Publication Data

US 2011/0163617 A1 Jul. 7, 2011

(30) Foreign Application Priority Data

Sep. 11, 2008 (JP) ..... 2008-233895

(51) Int. Cl.
*H01F 7/08* (2006.01)

(52) U.S. Cl. ..... 335/220; 251/129.15

(58) Field of Classification Search ..... 335/220–229; 251/129.01–129.22

See application file for complete search history.

(56) References Cited

U.S. PATENT DOCUMENTS

| | | | | |
|---|---|---|---|---|
| 4,339,109 | A | 7/1982 | Kawata et al. | |
| 4,521,759 | A | 6/1985 | Gibas | |
| 5,050,840 | A * | 9/1991 | Kondo et al. | 251/129.15 |
| 5,509,439 | A | 4/1996 | Tantardini | |
| 7,973,627 | B2 * | 7/2011 | Yamagata et al. | 335/255 |
| 2002/0057153 | A1 * | 5/2002 | Matsusaka et al. | 335/220 |
| 2005/0025632 | A1 * | 2/2005 | Urbank et al. | 417/222.2 |
| 2009/0140189 | A1 * | 6/2009 | Kokubu et al. | 251/129.15 |
| 2009/0236551 | A1 * | 9/2009 | Nomichi et al. | 251/129.15 |
| 2010/0301244 | A1 | 12/2010 | Gruen et al. | |
| 2011/0147629 | A1 * | 6/2011 | Gruen et al. | 251/129.15 |
| 2011/0168933 | A1 * | 7/2011 | Shimizu | 251/129.15 |

FOREIGN PATENT DOCUMENTS

DE 2639274 A1 3/1978

(Continued)

OTHER PUBLICATIONS

ISA Japanese Patent Office, International Search Report of PCT/JP2009/004110, Nov. 24, 2009, 2 pages.

(Continued)

*Primary Examiner* — Bernard Rojas

(74) *Attorney, Agent, or Firm* — Alleman Hall McCoy Russell & Tuttle LLP

(57) ABSTRACT

An oil immersed solenoid capable of easily and quickly removing air and air bubbles in oil in a space accommodating a movable core and preventing the air and the like from accumulating in the space. In an oil immersed solenoid in which a movable core is accommodated in a space of a tubular second guide so as to be movable in an axial direction of the second guide and the movable core is pulled by a fixed magnetic pole portion provided to be spaced apart from a tip end portion of the second guide, an air accumulation preventing portion is provided between the tip end portion of the second guide and a convex portion of a rear end portion of the fixed magnetic pole portion, and the second guide is made of a magnetic material and the air accumulation preventing portion is made of a non-magnetic material.

4 Claims, 4 Drawing Sheets

FOREIGN PATENT DOCUMENTS

| | | | |
|---|---|---|---|
| DE | 4438158 | A1 | 5/1995 |
| EP | 0428728 | A1 | 5/1991 |
| EP | 0464370 | A1 | 1/1992 |
| EP | 0465813 | A1 | 1/1992 |
| EP | 0552416 | A1 | 7/1993 |
| EP | 1855296 | A2 | 11/2007 |
| EP | 1887677 | A1 | 2/2008 |
| FR | 2728721 | A1 | 6/1996 |
| JP | 61-44811 | | 3/1986 |
| JP | 61168214 | | 7/1986 |
| JP | 64-48005 | | 3/1989 |
| JP | 3-80172 | | 8/1991 |
| JP | 5-52460 | | 7/1993 |
| JP | 6-2620 | | 1/1994 |
| JP | 07-302709 | | 11/1995 |
| JP | 63-145078 | | 9/1998 |
| JP | 2000-018416 | A | 1/2000 |
| JP | 2000-161527 | A | 6/2000 |
| JP | 2005-277306 | A | 10/2005 |
| JP | 2006-140417 | A | 6/2006 |
| WO | 2010012394 | A1 | 2/2010 |

OTHER PUBLICATIONS

Shimizu, Hiroaki, "Adjusting Screw Structure of Oil Immersed Solenoid and Oil Immersed Solenoid Including the Same," U.S. Appl. No. 13/063,188, filed Mar. 23, 2011, 36 pages.

ISA European Patent Office, Extended European Search Report of EP09812837.4, Oct. 12, 2011, Germany, 9 pages.

ISA Japanese Patent Office, International Search Report of PCT/JP2009/004024, Nov. 17, 2009, 2 pages.

* cited by examiner

OIL IMMERSED SOLENOID

TECHNICAL FIELD

The present invention relates to an oil immersed solenoid used in an oil-pressure device, such as a valve device, used in construction machinery or the like.

BACKGROUND ART

One example of such oil immersed solenoid is shown in FIG. 4(*a*). The oil immersed solenoid is used to control the oil pressure and flow rate of operating oil flowing in a valve device (not shown) that is, for example, an oil-pressure device. To be specific, in an oil immersed solenoid 1, when a command electric signal (exciting current) is transmitted to an exciting coil 2, pulling force (pulling force in a left direction in FIG. 4(*a*)) corresponding to the magnitude of the command electric signal is generated at a fixed magnetic pole portion 3, and the fixed magnetic pole portion 3 can pull a movable core 4 by the pulling force. When the movable core 4 is pulled, a rod 5 provided at the movable core 4 presses, for example, a spool (not shown) of a valve device (not shown) in the left direction in FIG. 4(*a*). This pressing force balances push-back force (push-back force in a right direction in FIG. 4(*a*)) based on, for example, spring force or pilot pressure applied to the spool. The spool stops at a position where the pressing force and the push-back force are balanced. With this, the oil pressure and flow rate of the operating oil flowing in the valve device can be controlled so as to be proportional to the command electric signal.

Then, as shown in FIG. 4(*a*), an annular gap 63 is formed between a tip end portion of a cylindrical second guide 20 and a rear end portion of the fixed magnetic pole portion 3. The reason why the gap 63 is formed is because a part of magnetic flux lines passing through the fixed magnetic pole portion 3 are prevented from leaking to the second guide 20 without passing through the movable core 4. Almost all of the magnetic flux lines generated in the fixed magnetic pole portion 3 are caused to pass through the movable core 4, and in this way the fixed magnetic pole portion 3 can efficiently pull the movable core 4.

Moreover, in order to cause the movable core 4 to smoothly move forward and backward and prevent corrosion, a space 6 in which the movable core 4 is accommodated is filled with oil, such as the operating oil. Further, in order that the oil in the space 6 can freely move between a space formed on a front side of the movable core 4 and a space formed on a rear side of the movable core 4 when the movable core 4 shown in FIG. 4(*a*) moves in a front-rear direction, two communication grooves 62 are formed on a side surface of the movable core 4 so as to extend in a center axis direction.

Another example of the oil immersed solenoid is disclosed in Japanese Laid-Open Utility Model Application Publication No. 6-2620 (see PTL 1, for example).

CITATAION LIST

Patent Literature

PTL 1: Japanese Laid-Open Utility Model Application Publication No. 6-2620

SUMMARY OF INVENTION

Technical Problem

However, in the conventional oil immersed solenoid 1 shown in FIG. 4(*a*), since the annular gap 63 is formed between the tip end portion of the second guide 20 and the rear end portion of the fixed magnetic pole portion 3, air or air bubbles may be accumulated in the gap 63. If the air or the air bubbles are accumulated in the gap 63, this may cause an irregular change in acceleration of the movable core 4, and chattering of the movable core 4 may occur.

Here, in order to remove the air or the air bubbles in the space 6 of the solenoid 1, an adjusting screw 9 is provided to threadedly engage with a rear lid portion 8 sealing a rear opening 7 of the second guide 20 as shown in FIG. 4(*a*). By loosening or removing the adjusting screw 9, the air or the air bubbles in the solenoid 1 can be removed.

Here, when removing the air or the air bubbles in the gap 63, as shown in FIGS. 4(*a*) and 4(*b*), an operator needs to adjust the position of the oil immersed solenoid 1 such that one of the communication grooves 62 formed on the movable core 4 is located at an upper portion of the movable core 4. However, since the communication grooves 62 cannot be visually confirmed from outside, it is difficult to surely and quickly remove the air and the like.

Moreover, another method for removing the air and the like in the gap 63 is a method for repeatedly turning on and off an operation of pulling the movable core 4 by the fixed magnetic pole portion 3, causing the movable core 4 to repeatedly move forward and backward by the above operation, and removing the air and the like in the gap 63 through a center hole 3*a* in which the rod 5 is inserted.

However, this method requires a long time to remove the air, and as such, work efficiency deteriorates.

Further, if the air and the like get in the oil and are accumulated in the gap 63 during the actual use of the oil immersed solenoid 1, this may affect the stability of the operation of a valve device, which is an oil-pressure device in which the oil immersed solenoid 1 is used.

The present invention was made to solve the above problems, and an object of the present invention is to provide an oil immersed solenoid capable of comparatively easily removing in a short period of time air or air bubbles in oil in a space in which a movable core is accommodated and capable of preventing the air and the like from accumulating in the space.

Solution to Problem

An oil immersed solenoid according to the present invention is an oil immersed solenoid in which a movable core is accommodated in a space of a tubular guide so as to be movable in an axial direction of the guide, and the movable core is pulled by a fixed magnetic pole portion provided to be spaced apart from an end portion of the guide, wherein: an air accumulation preventing portion is provided between the end portion of the guide and an end portion of the fixed magnetic pole portion; and the guide is made of a magnetic material and the air accumulation preventing portion is made of a non-magnetic material.

In accordance with the oil immersed solenoid of the present invention, when an electric signal is transmitted to, for example, an exciting coil, the magnetic pole is generated at the fixed magnetic pole portion, and the fixed magnetic pole portion can pull and move the movable core by the magnetic pole. Since the movable core is accommodated in the space of the tubular guide made of the magnetic material, magnetic flux lines from the fixed magnetic pole portion can pass through the movable core and the guide and return to the fixed magnetic pole portion, and a comparatively large pulling force can be generated.

In addition, since the air accumulation preventing portion made of the non-magnetic material is provided between the end portion of the guide made of the magnetic material and the end portion of the fixed magnetic pole portion, a part of the magnetic flux lines from the fixed magnetic pole portion can be prevented from passing through the air accumulation preventing portion made of the non-magnetic material. This can reduce flux leakage, and the magnetic flux lines can be caused to effectively pass through the movable core. With this, the fixed magnetic pole portion can generate the comparatively large pulling force.

Further, since the air accumulation preventing portion made of the non-magnetic material is provided between the end portion of the guide made of the magnetic material and the end portion of the fixed magnetic pole portion, it is possible to prevent the air and the air bubbles from accumulating at a portion where the air accumulation preventing portion is provided.

In the oil immersed solenoid according to the present invention, the space in which the movable core moves may be formed by a cylindrical body, and the cylindrical body may include the air accumulation preventing portion having an annular shape and the guide having a cylindrical shape.

As above, the cylindrical body is formed by components including the air accumulation preventing portion and the guide, and the movable core moves in the space in the cylindrical body. With this, a concave portion is not formed at a portion located on an outer side of an outer peripheral surface of the movable core, other than portions located on an outer side of the space in which the movable core moves forward and backward. The reason why the concave portion is not formed at the portion located on the outer side of the outer peripheral surface of the movable core is because the air and the like tend to be accumulated in such concave portion and is difficult to be removed. With this, the air and the like can be surely prevented from accumulating in the space in which the movable core is accommodated, and the air and the like in the oil can be surely removed.

In the oil immersed solenoid according to the present invention, the air accumulation preventing portion may be provided as a separate member separated from the guide and the fixed magnetic pole portion, or the air accumulation preventing portion may be provided to be coupled to the guide and the fixed magnetic pole portion.

As above, depending on, for example, the manufacturing step of the oil immersed solenoid, the air accumulation preventing portion may be provided as a separate member separated from the guide and the fixed magnetic pole portion or may be provided to be coupled to the guide and the fixed magnetic pole portion.

The oil immersed solenoid according to the present invention may further include: an adjusting spring configured to bias the movable core in a direction in which the movable core is pulled by the fixed magnetic pole portion; and an adjusting screw configured to be able to adjust biasing force of the adjusting spring.

The biasing force of the adjusting spring can be adjusted by rotating the adjusting screw in a direction in which the adjusting screw is tightened or loosened. By adjusting the biasing force of the adjusting spring, it is possible to adjust the biasing force in a direction in which the movable core moves toward the fixed magnetic pole portion. With this, the oil pressure and flow rate of the operating oil or the like flowing in, for example, the valve device in which the oil immersed solenoid is used can be adjusted.

Advantageous Effects of the Invention

In accordance with the oil immersed solenoid of the present invention, since the air accumulation preventing portion made of the non-magnetic material is provided between the end portion of the guide made of the magnetic material and the end portion of the fixed magnetic pole portion, the magnetic flux lines can be prevented from passing through the air accumulation preventing portion. This can reduce the flux leakage, and the fixed magnetic pole portion can generate a comparatively large pulling force.

In addition, since the air accumulation preventing portion is provided between the end portion of the guide made of the magnetic material and the end portion of the fixed magnetic pole portion without forming the space therebetween, the air and the air bubbles can be prevented from accumulating at a portion where the air accumulation preventing portion is provided, and the air and the air bubbles in the oil in the space (stroke volume) in which the movable core moves forward and backward can be comparatively easily removed through a predetermined air-bleeding hole in a short period of time by the forward and backward movements of the movable core. Therefore, the stability of the operation of the valve device that is, for example, the oil-pressure device in which the oil immersed solenoid is used can be improved.

BRIEF DESCRIPTION OF DRAWINGS

FIG. 1(*b*) is a cross-sectional view taken along line B-B of FIG. 1(*a*) and shows a movable core of the oil immersed solenoid.

FIG. 3(*b*) is a cross-sectional view taken along line C-C of FIG. 3(*a*) and shows the movable core of the oil immersed solenoid.

FIG. 4(*b*) is a cross-sectional view taken along line A-A of FIG. 4(*a*) and shows the movable core of the oil immersed solenoid.

DESCRIPTION OF THE EMBODIMENTS

Hereinafter, Embodiment 1 of an oil immersed solenoid according to the present invention will be explained in reference to FIGS. 1 and 2. An oil immersed solenoid 11 shown in FIG. 1(*a*) is used in a fluid device (oil-pressure device), such as a valve device (not shown), used in, for example, construction machinery (not shown). The oil immersed solenoid 11 is used to control the oil pressure and flow rate of a fluid, such as operating oil, flowing in the valve device. For example, the valve device is an electromagnetic proportional relief valve, and the oil immersed solenoid 11 is a proportional solenoid.

Figure 1:
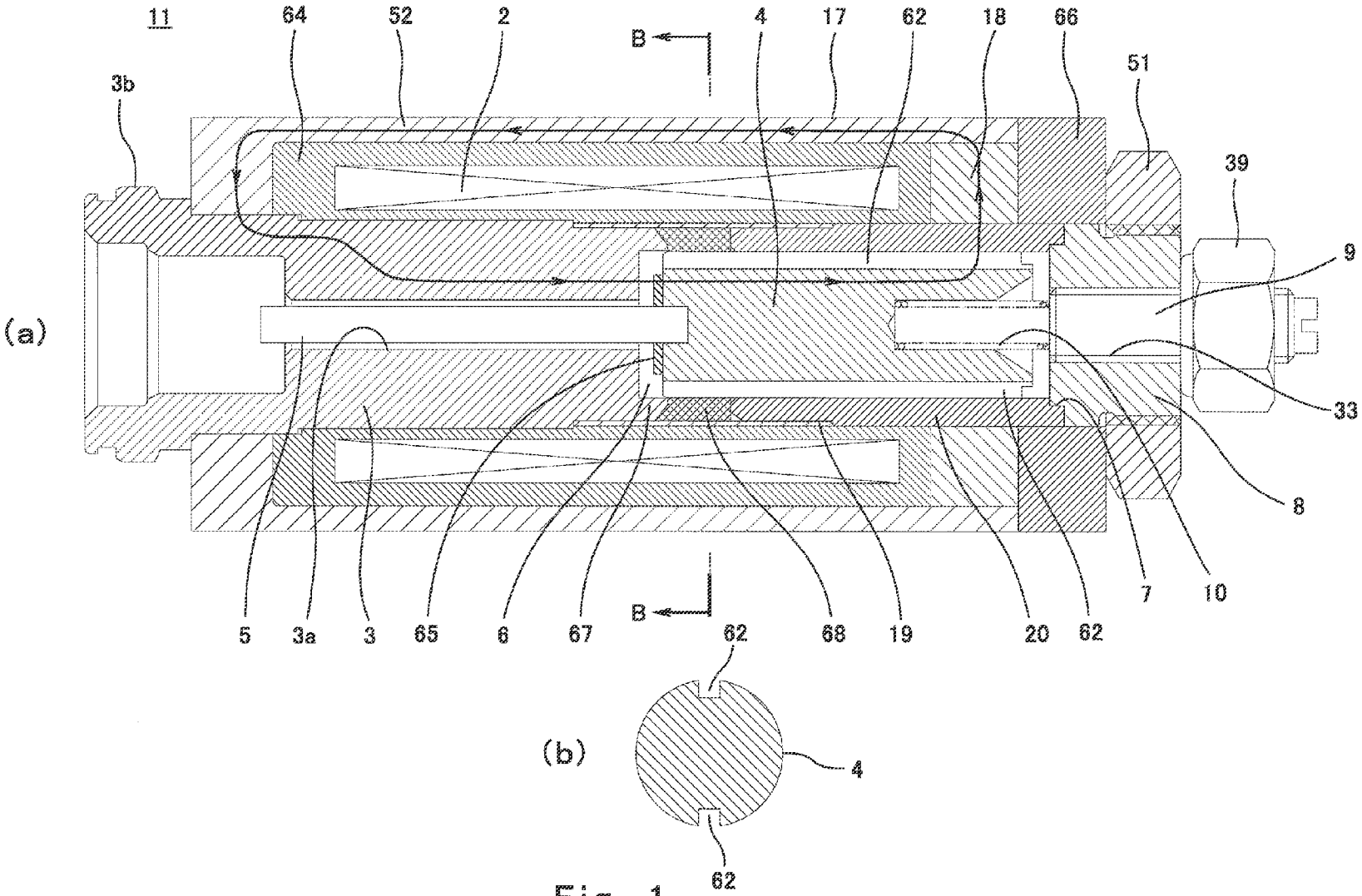
FIG. 1(*a*) is a longitudinal sectional view showing an oil immersed solenoid according to Embodiment 1 of the present invention.
Figure 2:
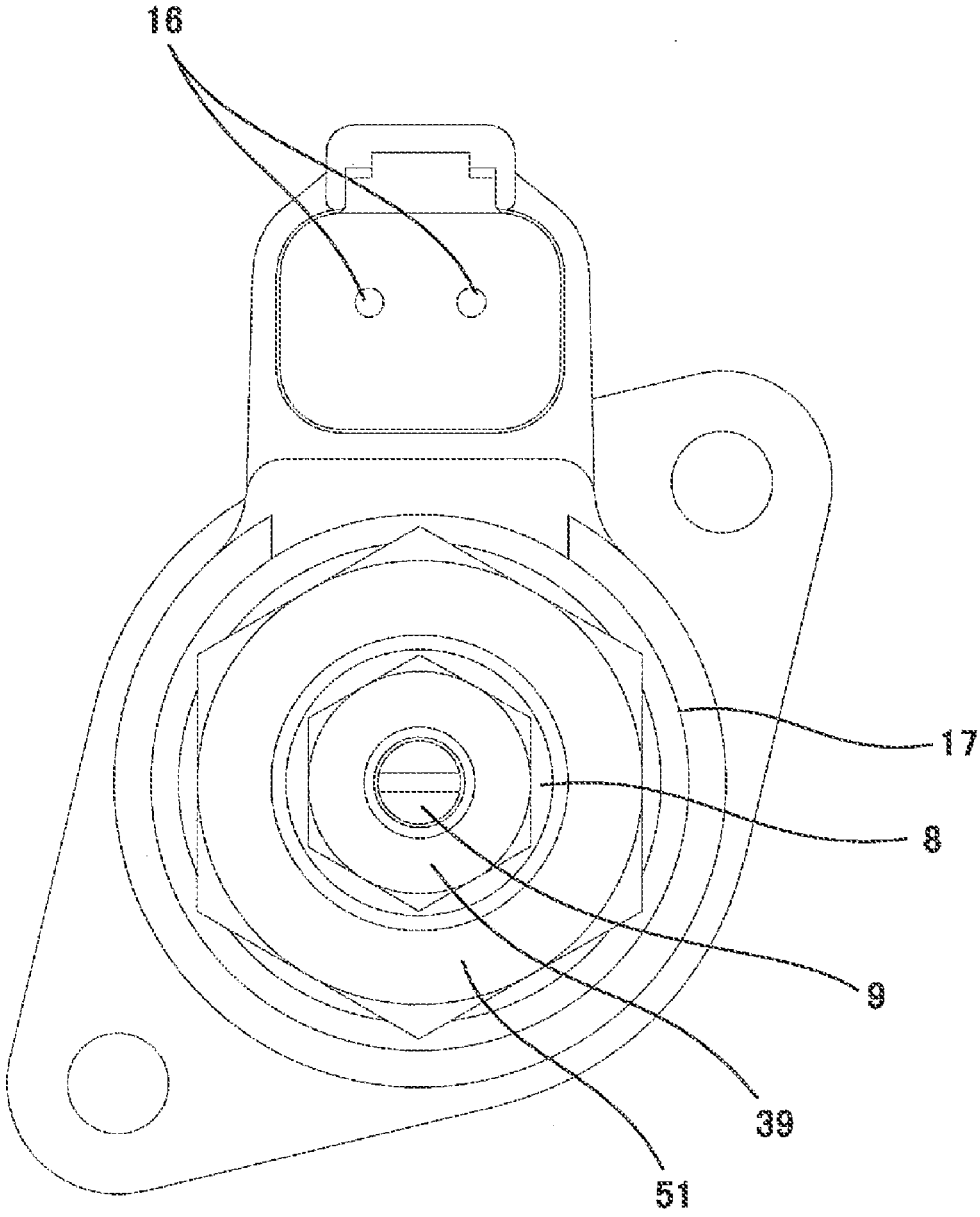
FIG. 2 is a side view showing the oil immersed solenoid according to Embodiment 1.

The oil immersed solenoid 11 shown in FIG. 1(*a*) includes: an exciting coil 2 to which a command electric signal (exciting current) is transmitted through terminals 16 shown in FIG. 2; a fixed magnetic pole portion 3 at which a magnetic pole is generated by the exciting coil 2; a movable core 4 configured to be pulled by the fixed magnetic pole portion 3; and an adjusting spring 10 configured to bias the movable core 4 in a direction in which the movable core 4 is pulled by the fixed magnetic pole portion 3.

The exciting coil 2 shown in FIG. 1(*a*) can receive the command electric signal (exciting current) transmitted through the terminals 16 shown in FIG. 2 and generate the magnetic pole at the fixed magnetic pole portion 3 by the command electric signal. The exciting coil 2 shown in FIG.

1(*a*) is formed to have a substantially short cylindrical shape and is electrically insulated from the other components by an insulating portion 64. Then, the exciting coil 2 is accommodated in a substantially short cylindrical metal main body case 17 and an annular yoke 18.

A controller (not shown) freely adjusts the magnitude of the command electric signal within a predetermined range and transmits the command electric signal to the exciting coil 2. With this, the fixed magnetic pole portion 3 can generate pulling force (magnetic pole) corresponding to the magnitude of the command electric signal.

The magnetic pole is generated at the fixed magnetic pole portion 3 by the exciting coil 2, and the fixed magnetic pole portion 3 can pull the movable core 4 by the magnetic pole (pulling force in a left direction in FIG. 1(*a*)). The pulling force corresponds to the magnitude of the command electric signal transmitted to the exciting coil 2.

As shown in FIG. 1(*a*), the fixed magnetic pole portion 3 is formed to have a substantially short columnar shape and is provided on an inner side of the exciting coil 2 and the like. A left tip end portion of an outer peripheral surface of the fixed magnetic pole portion 3 is positioned on an inner side of a tip end portion of a main body case 17, a substantially center portion of the outer peripheral surface of the fixed magnetic pole portion 3 is positioned on an inner side of a tip end portion of the exciting coil 2. Then, a rear end portion of the outer peripheral surface of the fixed magnetic pole portion 3 is positioned on an inner side of a tip end portion of a short cylindrical first guide 19.

As shown in FIG. 1(*a*), the movable core 4 is formed to have a substantially short columnar shape, provided on an inner side of the short cylindrical second guide 20, and is movable in the left and right directions in FIG. 1(*a*) along an inner surface of the second guide 20.

To be specific, the movable core 4 receives a biasing force in the left direction in FIG. 1(*a*) by the pulling force of the fixed magnetic pole portion 3. When the movable core 4 is pulled by the fixed magnetic pole portion 3, the rod 5 provided at the movable core 4 presses, for example, a spool of a valve device (not shown) in the left direction in FIG. 1(*a*). This pressing force balances push-back force (push-back force in the right direction in FIG. 1(*a*)) based on, for example, spring force or pilot pressure applied to the spool. The spool stops at a position where the pressing force and the push-back force are balanced. With this, the oil pressure and flow rate of, for example, the operating oil flowing in the valve device can be controlled so as to be proportional to the command electric signal.

A left tip end portion of an outer peripheral surface of the second guide 20 is positioned on an inner side of a rear end portion of the first guide 19, and a substantially center portion of the outer peripheral surface of the second guide 20 is positioned on an inner side of a rear end portion of the exciting coil 2. Then, a rear end portion of the outer peripheral surface of the second guide 20 is positioned on an inner side of the annular yoke 18. The yoke 18 is positioned on an inner side of a rear end portion of the main body case 17.

Moreover, as shown in FIG. 1(*a*), a concave portion is formed at a center portion of a rear end surface of the fixed magnetic pole portion 3, and an inner peripheral surface of the concave portion is formed by an annular convex portion 67. Then, an outer peripheral surface of a right rear end portion of the fixed magnetic pole portion 3 including the annular convex portion 67 is coupled to an inner peripheral surface of the tip end portion of the first guide 19. Moreover, an inner peripheral surface of the rear end portion of the first guide 19 is coupled to an outer peripheral surface of a tip end portion of the second guide 20.

Then, a rear end surface of the annular convex portion 67 formed at the rear end portion of the fixed magnetic pole portion 3 is positioned to be spaced apart from a tip end surface of the second guide 20, and an air accumulation preventing portion 68 that is one feature of the present invention is provided between the rear end surface of the convex portion 67 and the tip end surface of the second guide 20.

The air accumulation preventing portion 68 is provided as a separate member separated from the second guide 20 and the fixed magnetic pole portion 3. However, the air accumulation preventing portion 68 may be provided to be coupled to the second guide 20 and the fixed magnetic pole portion 3. As above, depending on, for example, a manufacturing step of the oil immersed solenoid, the air accumulation preventing portion 68 may be provided as a separate member separated from the second guide 20 and the fixed magnetic pole portion 3. Moreover, the air accumulation preventing portion 68 may be provided to be coupled to the second guide 20 and the fixed magnetic pole portion 3 by welding, adhesive, or the like.

Then, the movable core 4 is provided in the space 6 formed in and by the fixed magnetic pole portion 3, the first guide 19, and the second guide 20. The movable core 4 is movable in the left and right directions in FIG. 1(*a*) in the space 6.

As shown in FIG. 1(*a*), the space in which the movable core moves is formed by a cylindrical body. The cylindrical body is formed by the annular convex portion 67, the annular air accumulation preventing portion 68, the cylindrical second guide 20, and the first guide 19.

Further, as shown in FIG. 1(*a*), in order to allow the movable core 4 to smoothly move forward and backward and prevent corrosion, the space 6 in which the movable core 4 is accommodated is filled with oil, such as operating oil. Further, in order that the oil in the space 6 can freely move between a space formed on a front side of the movable core 4 and a space formed on a rear side of the movable core 4 when the movable core 4 moves in the front-rear direction, two communication grooves 62 are formed on a side surface of the movable core 4 so as to extend in parallel with a center axis direction.

As shown in FIG. 1(*b*), each of these two communication grooves 62 has a rectangular cross section. Moreover, these two communication grooves 62 are formed at positions separated from each other by 180° in a circumferential direction of the movable core 4. Further, when the movable core 4 moves, the communication grooves 62 allow the oil, such as the operating oil, in the space 6 to flow therethrough, and thus, allow the movable core 4 to perform a low-impact, smooth movement by utilizing fluid resistance of the oil. Reference number 65 in FIG. 1(*a*) is a spacer.

Then, as shown in FIG. 1(*a*), the rod 5 is provided at a tip end portion of the movable core 4. The rod 5 is inserted in a center hole 3*a* so as to be movable in an axial direction. The center hole 3*a* is formed to penetrate the center of the fixed magnetic pole portion 3. A tip end portion of the rod 5 contacts a rear end portion of the spool of the valve device (not shown). Moreover, a tip end portion 3*b* of the fixed magnetic pole portion 3 is coupled to the valve device.

Moreover, as shown in FIG. 1(*a*), the rear lid portion 8 is coupled to the rear opening 7 of the second guide 20, so that the rear opening 7 is sealed. The first and second guides 19 and 20 and fixed magnetic pole portion 3 coupled to the rear lid portion 8 are fastened and fixed to the main body case 17 by a fixing nut 51. A collar 66 is provided between the fixing nut 51 and a right rear end portion of the main body case 17.

The collar 66 is coupled to the rear end portion of the main body case 17 and the yoke 18.

Further, the adjusting screw 9 threadedly engages with the rear lid portion 8, and the adjusting spring 10 is provided at a tip end portion of the adjusting screw 9. A tip end portion of the adjusting spring 10 is attached to an attaching concave portion formed at a rear end portion of the movable core 4. With this, the adjusting spring 10 can bias the movable core 4 by a desired force (force set by an operator) in a pulling direction (left direction in FIG. 1(*a*)) in which the fixed magnetic pole portion 3 pulls the movable core 4.

The biasing force of the adjusting spring 10 can be adjusted by operating the adjusting screw 9 by the operator. As above, by adjusting the biasing force of the adjusting spring 10, it is possible to adjust the force of the rod 5 provided at the movable core 4, the force pressing the spool of the valve device.

As above, the pressing force of the rod 5 with respect to the spool is adjusted because the oil pressure and flow rate of the operating oil flowing in the valve device are adjusted to be a predetermined oil pressure and flow rate corresponding to the command electric signal when the command electric signal is transmitted to the exciting coil 2.

Then, as shown in FIG. 1(*a*), a seal nut 39 threadedly engages with the adjusting screw 9. The seal nut 39 can fix the adjusting screw 9 to the rear lid portion 8 and seal a gap between the adjusting screw 9 and an internal screw portion 33 in a fixed state.

Moreover, the space 6 shown in FIG. 1(*a*) is in communication with an inner portion of the valve device via the center hole 3*a* of the fixed magnetic pole portion 3. With this, the operating oil in the valve device flows through the center hole 3*a* to the space 6.

Further, each of the fixed magnetic pole portion 3, the movable core 4, the second guide 20, and the main body case 17 shown in FIG. 1(*a*) is made of a magnetic metal. The air accumulation preventing portion 68 is made of a non-magnetic material, such as a metal or synthetic resin. One example of the metal is a copper-based alloy. The first guide 19 is made of a non-magnetic metal. The collar 66 is made of non-magnetic synthetic resin.

Next, the operations of the oil immersed solenoid 11 configured as above and shown in FIGS. 1 and 2 will be explained. The oil immersed solenoid 11 shown in FIG. 1(*a*) can be used to control the oil pressure and flow rate of the fluid, such as the operating oil, flowing in the valve device (not shown) that is, for example, the oil-pressure device. To be specific, in the oil immersed solenoid 11, when the command electric signal (exciting current) is transmitted to the exciting coil 2, the pulling force (pulling force in the left direction in FIG. 1(*a*)) corresponding to the magnitude of the command electric signal is generated at the fixed magnetic pole portion 3, and the fixed magnetic pole portion 3 can pull the movable core 4 by the pulling force.

When the movable core 4 is pulled, the rod 5 provided at the movable core 4 presses the spool of the valve device (not shown) in the left direction as shown in FIG. 1(*a*). The pressing force balances the push-back force (push-back force in the right direction in FIG. 1(*a*)) based on, for example, the spring force or pilot pressure applied to the spool. The spool stops at a position where the pressing force and the push-back force are balanced. With this, the oil pressure and flow rate of the operating oil flowing in the valve device can be controlled to be proportional to the command electric signal.

Even among the standardized oil immersed solenoids 11 shown in FIG. 1(*a*), each solenoid 11 has its own characteristics, and the sizes of the parts constituting the solenoids 11 vary. Therefore, even if the same command electric signal is transmitted, the pressure and flow rate of the operating oil vary. Therefore, the variations of each of the pressure and flow rate need to be kept within an allowable range.

Here, the operator can adjust the biasing force of the adjusting spring 10 by rotating the adjusting screw 9 of FIG. 1(*a*) in a direction in which the adjusting screw 9 is tightened or loosened. By adjusting the biasing force of the adjusting spring 10, it is possible to adjust the biasing force in a direction (left direction in FIG. 1(*a*)) in which the movable core 4 moves toward the fixed magnetic pole portion 3. With this, the oil pressure and flow rate of the operating oil or the like flowing in, for example, the valve device in which the oil immersed solenoid 11 is used, can be adjusted by the adjusting screw 9 in advance or accordingly such that each of the oil pressure and flow rate falls within a predetermined allowable range.

Moreover, if the air or the air bubbles exist in the oil, such as the operating oil, in the space 6 of the oil immersed solenoid 11 as shown in FIG. 1(*a*), this may cause an irregular change in acceleration of the movable core 4, and chattering of the movable core 4 may occur.

Here, in order to remove the air or the air bubbles in the space 6 of the solenoid 11, the operator loosens or removes the adjusting screw 9, so that the air or the air bubbles in the oil in the space 6 can be removed through an internal screw hole of the rear lid portion 8, the internal screw portion 33 being formed at the internal screwhole of the rear lid portion 8.

When removing the air and the like in the space 6, for example, the oil, such as the operating oil, can be supplied through the tip end portion 3*b* of the solenoid 11 to cause the air and the like in the space 6 to flow out through the internal screw hole.

Moreover, in accordance with the oil immersed solenoid shown in FIG. 1(*a*), since the movable core 4 is accommodated in the space 6 of the tubular second guide 20 made of the magnetic material, the magnetic flux lines from the fixed magnetic pole portion 3 can pass through the movable core 4, the second guide 20, and the main body case 17 and return to the fixed magnetic pole portion 3 as shown by a magnetic route 52, and a comparatively large pulling force can be generated.

In addition, since the air accumulation preventing portion 68 made of the non-magnetic material is provided between the tip end portion of the second guide 20 made of the magnetic material and the rear end portion (convex portion 67) of the fixed magnetic pole portion 3, a part of the magnetic flux lines from the fixed magnetic pole portion 3 can be prevented from passing through the air accumulation preventing portion 68 made of the non-magnetic material. This can reduce flux leakage, and the magnetic flux lines can be caused to effectively pass through the movable core 4. With this, the fixed magnetic pole portion 3 can generate the comparatively large pulling force.

Further, since the air accumulation preventing portion 68 is provided between the end portion of the second guide 20 and the convex portion 67 of the fixed magnetic pole portion 3, it is possible to prevent the air or the air bubbles from accumulating at a portion where the air accumulation preventing portion 68 is provided.

Then, the air or the air bubbles in the oil in the space 6 (stroke volume) in which the movable core 4 move forward and backward can be comparatively easily removed through, for example, the center hole 3*a* by the forward and backward movements of the movable core 4 in a short period of time.

Therefore, the stability of the operation of the valve device that is, for example, the oil-pressure device in which the oil immersed solenoid 11 is used can be improved.

Moreover, as shown in FIG. 1(*a*), the cylindrical body is formed by components including the air accumulation preventing portion 68, the second guide 20, and the convex portion 67 of the fixed magnetic pole portion 3, and the movable core 4 moves in the space 6 in the cylindrical body. With this, a concave portion is not formed at a portion located on an outer side of an outer peripheral surface of the movable core 4, other than portions located on an outer side of the space 6 in which the movable core 4 moves forward and backward. The reason why the concave portion is not formed at the portion located on the outer side of the outer peripheral surface of the movable core 4 is because the air and the like tend to be accumulated in such concave portion and is difficult to be removed. With this, the air and the like can be surely prevented from accumulating in the space 6 in which the movable core 4 is accommodated, and the air and the like in the oil can be surely removed.

Figure 3:
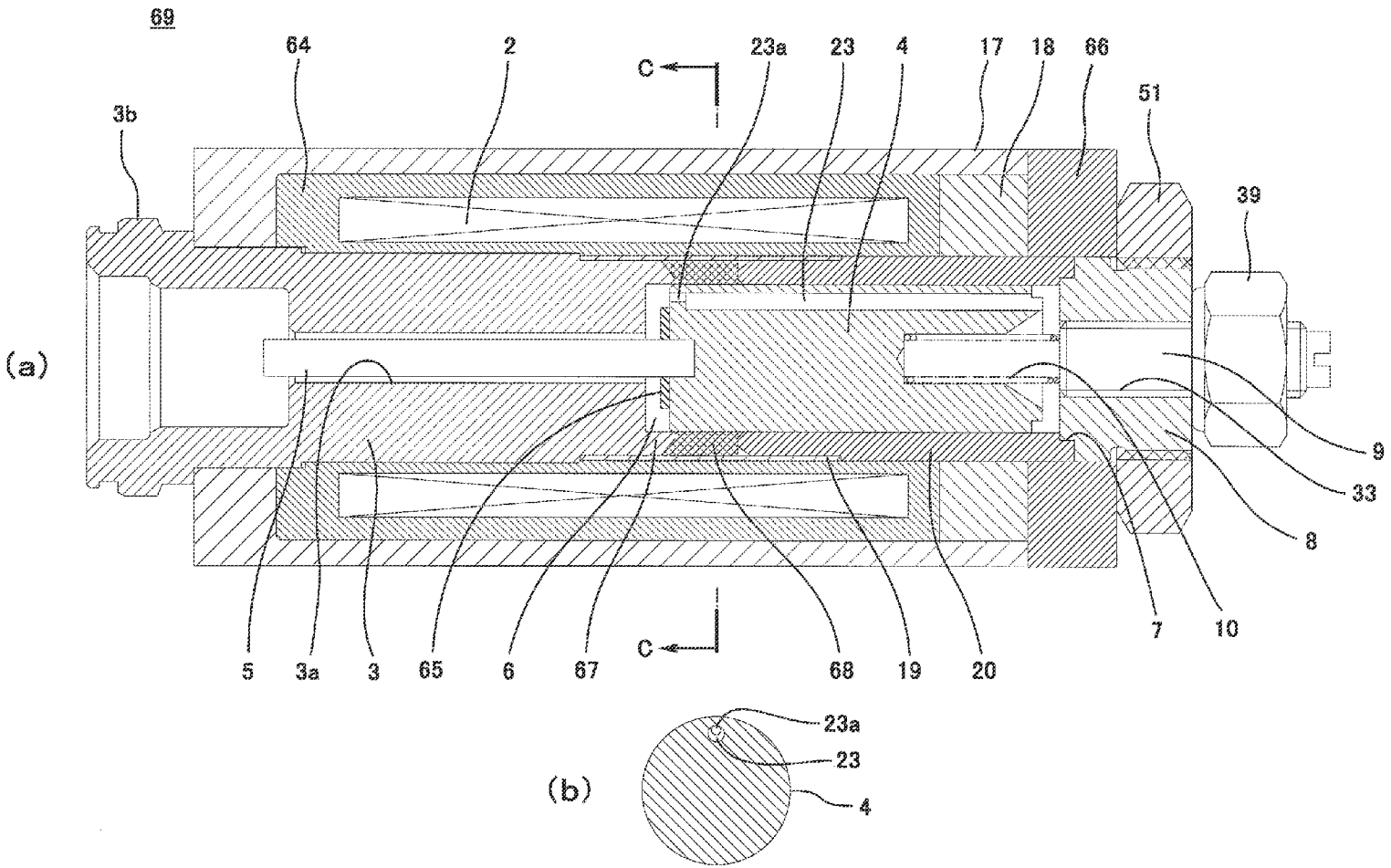
FIG. 3(*a*) is a longitudinal sectional view showing the oil immersed solenoid according to Embodiment 2 of the present invention.
Figure 4:
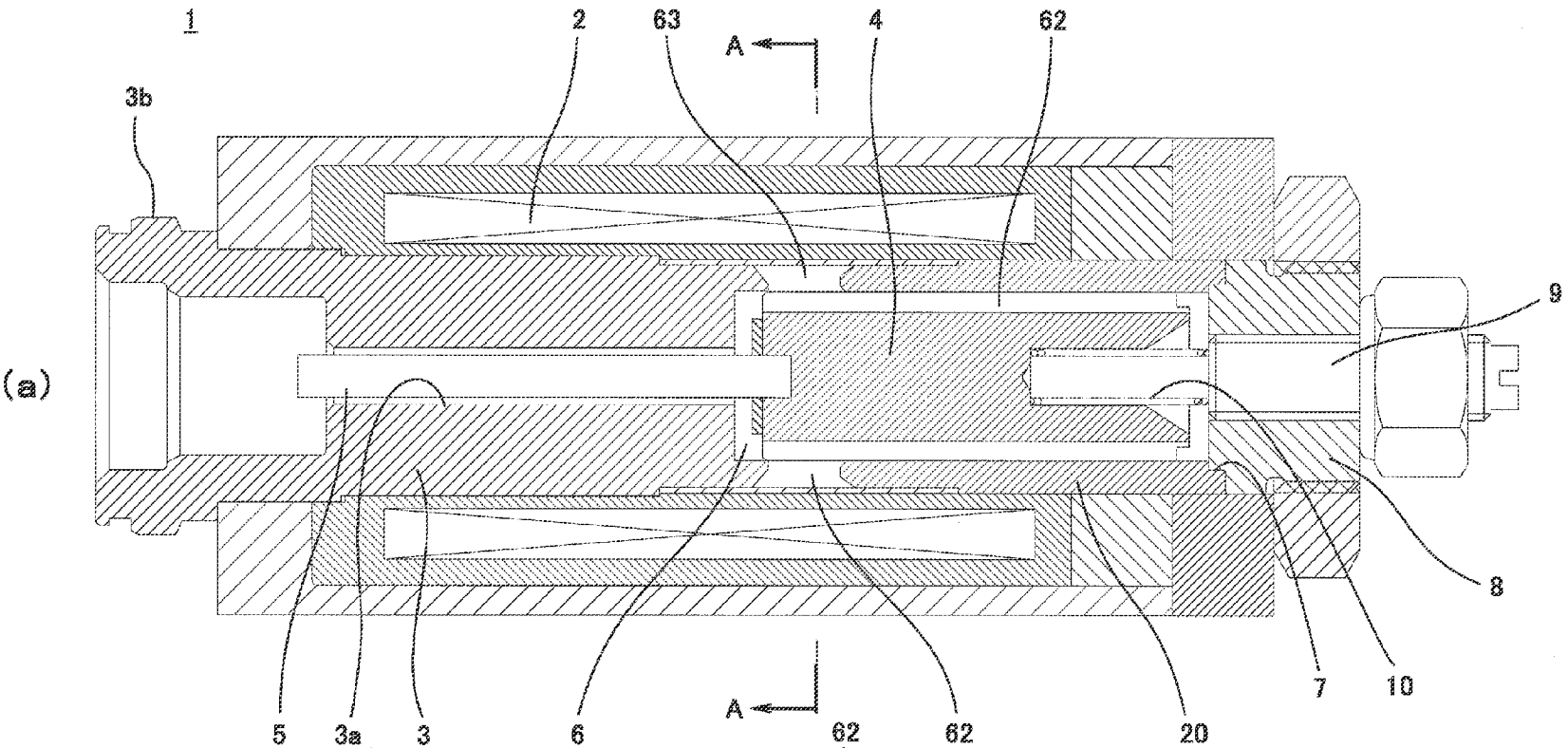
FIG. 4(*a*) is a longitudinal sectional view showing one example of conventional oil immersed solenoids.
Figure 4:
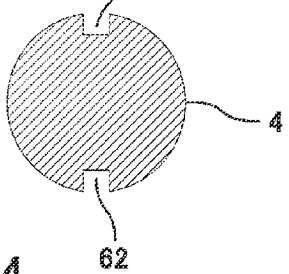

Next, Embodiment 2 of the oil immersed solenoid according to the present invention will be explained in reference to FIGS. 3(*a*) and 3(*b*). The difference between Embodiment 2 shown in FIGS. 3(*a*) and 3(*b*) and Embodiment 1 shown in FIGS. 1(*a*) and 1(*b*) is that in Embodiment 1 shown in FIGS. 1(*a*) and 1(*b*), two communication grooves 62 extending in parallel with the center axis direction are formed on the side surface of the movable core 4, and in Embodiment 2 as shown in FIGS. 3(*a*) and 3(*b*), a through hole 23 and a narrow hole 23*a* are formed on the movable core 4. Other than this, Embodiment 2 is the same in configuration and operation as Embodiment 1. Therefore, the same reference signs are used for the same components, and explanations thereof are omitted.

As shown in FIGS. 3(*a*) and 3(*b*), the through hole 23 is formed on the movable core 4 of the oil immersed solenoid 69 of Embodiment 2 so as to be open on both end surfaces of the movable core 4 and extend in parallel with an axial direction of the movable core 4. The narrow hole 23*a* is formed at one end portion of the through hole 23. When the movable core 4 moves forward and backward, the through hole 23 and the narrow hole 23*a* allow the oil, such as the operating oil, in the space 6 to flow therethrough, and thus, allow the movable core 4 to perform a low-impact, smooth movement by utilizing fluid resistance of the oil.

Although the present invention is applied to each of the oil immersed proportional solenoids 11 and 69 as shown in FIGS. 1 to 3 in Embodiments 1 and 2, the present invention may be applied to another oil immersed proportional solenoid instead.

Then, although the present invention is applied to each of the oil immersed proportional solenoids 11 and 69 as shown in FIGS. 1 to 3 in Embodiments 1 and 2, the present invention may be applied to an on-off type oil immersed solenoid having a different configuration and not including the adjusting screw 9 and the adjusting spring 10.

REFERENCE SIGNS LIST

1, 11, 69 oil immersed solenoid
2 exciting coil
3 fixed magnetic pole portion
3*a* center hole
3*b* tip end portion
4 movable core
5 rod
6 space
7 rear opening
8 rear lid portion
9 adjusting screw
10 adjusting spring
16 terminal
17 main body case
18 yoke
19 first guide
20 second guide
23 through hole
23*a* narrow hole
33 internal screw portion
39 seal nut
51 fixing nut
52 magnetic route
62 communication groove
63 gap
64 insulating portion
65 spacer
66 collar
67 convex portion of the fixed magnetic pole portion
68 air accumulation preventing portion

The invention claimed is:

1. An oil immersed solenoid, comprising:

a tubular guide made of a magnetic material and having first and second end portions;

an exciting coil provided outside the guide;

a fixed magnetic pole portion at which a magnetic pole is generated by the exciting coil, the fixed magnetic pole portion being provided to be spaced apart from the first end portion of the guide;

a movable core accommodated in a space of the guide so as to be movable in an axial direction of the guide, the movable core being pulled by the fixed magnetic pole portion; and an air accumulation preventing portion made of a non-magnetic material and provided between the first end portion of the guide and an end portion of the fixed magnetic pole portion;

wherein the second end portion of the guide is sealed by a lid portion, a fixing nut threadedly engaging with the lid portion, a yoke provided between the fixing nut and the exciting coil, and a collar made of a non-magnetic synthetic resin provided between the yoke and the fixing nut.

2. The oil immersed solenoid according to claim 1, wherein the space in which the movable core moves is formed by a cylindrical body, and the cylindrical body includes the air accumulation preventing portion having an annular shape and the guide having a cylindrical shape.

3. The oil immersed solenoid according to claim 1, wherein the air accumulation preventing portion is provided as a separate member separated from the guide and the fixed magnetic pole portion, or the air accumulation preventing portion is provided to be coupled to the guide and the fixed magnetic pole portion.

4. The oil immersed solenoid according to claim 1, further comprising:

an adjusting spring configured to bias the movable core in a direction in which the movable core is pulled by the fixed magnetic pole portion; and an adjusting screw configured to be able to adjust biasing force of the adjusting spring.

* * * * *